United States Patent [19]

Bartlett

[11] 4,008,707

[45] Feb. 22, 1977

[54] REMOVABLE FIREPLACE HEATER

[76] Inventor: Robert N. Bartlett, 77 Walnut Ave., Atherton, Calif. 94025

[22] Filed: Feb. 27, 1975

[21] Appl. No.: 553,770

Related U.S. Application Data

[63] Continuation of Ser. No. 432,020, Jan. 9, 1974, abandoned.

[52] U.S. Cl. ..... 126/131; 126/121

[51] Int. Cl.² ..... F24B 7/00

[58] Field of Search ..... 126/131, 121, 129

[56] References Cited

UNITED STATES PATENTS

| | | | |
|---|---|---|---|
| 2,052,643 | 9/1936 | Modine | 126/121 |
| 2,359,197 | 9/1944 | Brooks | 126/121 |
| 2,362,526 | 11/1944 | Austin | 126/121 |
| 2,828,078 | 3/1958 | Snodgrass | 126/121 X |
| 3,866,595 | 2/1975 | Jones | 126/121 |

FOREIGN PATENTS OR APPLICATIONS

| | | | |
|---|---|---|---|
| 518,401 | 5/1921 | France | 126/121 |
| 606,631 | 6/1926 | France | 126/121 |
| 74,394 | 12/1948 | Norway | 126/121 |
| 48,059 | 8/1917 | Switzerland | 126/121 |

*Primary Examiner*—William F. O'Dea
*Assistant Examiner*—Harold Joyce
*Attorney, Agent, or Firm*—Townsend and Townsend

[57] ABSTRACT

An improved fireplace heater for placement in a conventional fireplace. The heater is comprised of a hollow body having a number of interconnected, hollow sections adapted to fit substantially in place near the inner wall faces of the fireplace. The heater has front, open-end portions extending laterally of the fireplace opening to permit air to be drawn laterally into the heater itself and, after passing therethrough, to be driven laterally out of the heater. Means is provided in one of such front portions for creating a flow of air under pressure through the heater sections. The inner surface of each heater section is corrugated to increase the surface area thereof. The heater has adjustable legs and adjustable decorative panels to allow it to be adjusted for fireplaces of different sizes.

2 Claims, 3 Drawing Figures

REMOVABLE FIREPLACE HEATER

This is a continuation of application Ser. No. 432,020, filed Jan. 9, 1974, now abandoned.

This invention relates to improvements in fireplaces and, more particularly, to a removable fireplace heater for conserving the energy generated by the burning of logs and other materials in the fireplace.

BACKGROUND OF THE INVENTION

Fireplaces have been used for cooking, for "atmosphere" and for heating purposes. The construction of conventional fireplaces is such that they are inefficient as space heaters. Previous attempts have been made to improve the heating efficiency of fireplaces by various built-in devices, such as surrounding plenums or flue heat exchangers. Generally, most fireplaces have been constructed with no such provision to increase the heating efficiency.

SUMMARY OF THE INVENTION

The present invention provides a fireplace heater which immediately changes an existing fireplace into an efficient heating device while at the same time does not affect the decorative or esthetic appearance of the fireplace itself. Thus, while the fireplace can be continued to enjoyed in the usual manner, it can also be used as an efficient space heater. Also, burnable wastes such as newspapers, wrappings, etc. normally disposed of in other ways can be burned to provide heat. With even a moderate fire, the heater of the present invention has an output that approaches that of a relatively large wall-type space heater.

The heater of this invention utilizes a tubular, hollow body which is shaped so that it fits compactly into a fireplace, namely, along the inner wall surfaces of the fireplace in partially surrounding relationship to the combustion area thereof. Thus, the heater in effect becomes a new wall structure in heat exchange relationship to the combustion area so that heat energy from such area, which is directed toward the heater by radiation and convention, will be absorbed thereby and then transferred to air flowing through the body itself. The airflow is generated by fan means at one end of the body so that the air is forced under pressure into and through the body and exits therefrom in a heated condition from the opposite end of the body.

The heater has legs on the lower margin of the body to permit adjustment of the same so that it can fit in fireplaces of different sizes. Also, the fan means is provided with an electric motor near the air inlet side of the heater so that incoming air, which is moderately cool, will maintain the motor in a cooled condition during use. Furthermore, the motor is housed in an extension extending laterally from one end of the housing so that the motor itself is sufficiently remote from the combustion area of the fireplace so as not to be subjected to the heat radiated therefrom. Both the inlet and outlet ends of the heater are provided with lateral extensions to assure a proper circulation of air in the room heated by the air exiting from the heater. Also, the arrangement of the extensions assures that combustion air from the fireplace is not drawn into the room by venturi action and the heater itself can be decorative in appearance notwithstanding its functional characteristics.

The primary object of this invention is to provide an improved fireplace heater which can be removably placed in a fireplace without detracting from its functional characteristics yet the heater can provide a means for utilizing a part of the heat energy generated in the combustion area of a fireplace so as to render the latter more efficient in operation.

Another object of this invention is to provide a fireplace heater of the type described wherein the heater is safe in operation, is relatively easy to install in a fireplace, and is adjustable to fit fireplaces of different heights so that as to render it versatile in use.

A further object of this invention is to provide a fireplace heater of the aforesaid character which has corrugated inner surfaces facing the combustion area of the fireplace when the heater is mounted therein so that the effective surface area of the heater is increased to increase the rate of heat transfer to air flowing through the heater.

A further object of this invention is to provide a fireplace heater of the aforesaid character which utilizes hollow inlet and outlet extensions on the ends of a pair of side sections of the heater itself wherein the extensions promote optimum air circulation in the room heated by the air from the heater yet combustion gases are not drawn through the heater and the fan means for creating the flow of air through the heater is kept relatively cool at all times and can be effectively housed near the air inlet side of the heater.

Other objects of this invention will become apparent as the following specification progresses, reference being had to the accompanying drawings for an illustration of the invention.

Figure 1:
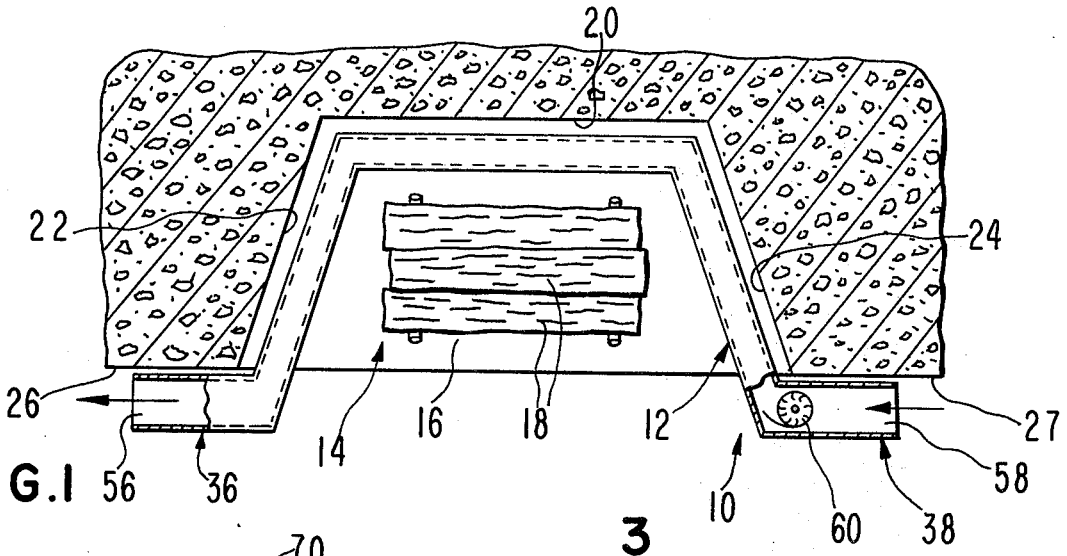
FIG. 1 is a top plan view of the heater installed in a fireplace.

The fireplace heater of this invention is broadly denoted by the numeral 10 and includes a hollow body 12 which is adapted to be movably placed in a fireplace 14 of the conventional type having a combustion area 16 in which logs 18 are to be burned. The fireplace is defined by a rear wall 20 and a pair of opposed sidewalls 22 and 24. Typically, the fireplace has flat front faces 26 and 27 on opposite sides of the central opening of the fireplace. Body 12 is provided with a number of adjustable legs 28 (FIG. 2) by means of which the height of the heater can be adjusted when the heater is in the fireplace. Thus, the heater can be adjusted to fit fireplaces of different heights.

Heater 10 includes a hollow central section 30, a pair of hollow side sections 32 and 34, and a pair of lateral, hollow extensions 36 and 38 projecting laterally from the ends of side sections 32 and 34, respectively. Extensions 36 and 38 project in opposed directions as shown in FIG. 1. The body, including the various sections and extensions, is formed from a sheetmetal material having a relatively high coefficient of thermal conductivity.

Figure 3:
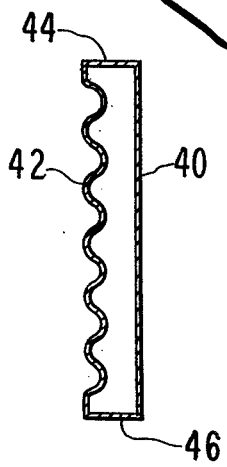
FIG. 3 is a cross-sectional view taken along line 3—3 of FIG. 2.

Each of the three sections 30, 32 and 34 has a cross section which is of the type shown in FIG. 3 including a flat outer wall 40, a corrugated inner wall 42, and flat top and bottom walls 44 and 46. Inner wall 42 faces the combustion area 16; whereas, the wall 40 is adjacent to the corresponding wall of the fireplace when heater 10 is in the operative position shown in FIG. 1.

Each of extensions 36 and 38 has the same cross section as the other, namely, a front, flat wall 48 (FIG. 2), a rear flat wall 50 parallel to wall 48, and flat top and bottom walls 52 and 54. Legs 28 are adjustably coupled to the rear surfaces of sections 32 and 34.

Extensions 36 and 38 have openings 56 and 58, respectively. Opening 58 defines the air inlet to heater 10 and opening 56 defines the air outlet thereof.

Means is provided in extension 38 for creating a flow of air into opening 58, through body 12, and out of the body through opening 56. Such means, for purposes of illustration, includes a pair of fan rotors 60 and 62 mounted on the drive shaft 64 of an electric motor 66 mounted in any suitable manner within extension 38, such as by brackets (not shown). The outer shaft ends of rotors 60 and 62 are mounted in upper and lower walls 52 and 54 of extension 38 so that, when the motor is energized, air is driven into opening 58 and forced through body 12 under pressure. As the air passes through the body, it is heated by the heat energy absorbed by sections 30, 32 and 34 so that, when the air is moved out of the opening 56, it is heated so as to heat the atmosphere of the room in which the fireplace is disposed.

In use, heater 10 is first placed in fireplace 14 in the manner shown in FIG. 1 with central section 30 adjacent to rear wall 20 and sections 32 and 34 adjacent to sidewalls 22 and 24. In such a case, extensions 36 and 38 are adjacent to the flat front faces 26 and 27 of the fireplace. Motor 66 is energized by connecting the same to a source of electrical power so that rotors 60 and 62 are rotated to cause a flow of air into opening 58, through extension 38, sections 34, 30 and 32, and then through extension 36 and outwardly therefrom through opening 56 into the room. The air in body 12 is heated by conduction and radiation. As it passes out of heater 10, the heated air heats the room so that energy is conserved inasmuch as the fireplace becomes more efficient as a heat source.

A number of features of heater 10 operate to cause it to function in a manner to enhance its capabilities. For instance, the fact that extensions 36 and 38 extend and project away from each other promotes air circulation around the room into which the heated air is directed. Also, and most importantly, if air were to be drawn directly into the front end of section 34 (assuming that extension 38 is eliminated) and directed out of extension 32 at its front end (assuming extension 36 were eliminated) by virtue of the venturi principle, combustion air would also be drawn out of the fireplace and into the room. This would create a dangerous condition as well as an unpleasant one due to odors of combustion gases.

Since motor 66 is mounted at the inlet end of heater 10, the motor is mounted out of the heated part of the heater and the air flowing over the motor will always keep it cool. Since the blower system is of the pressure type rather than the suction type, air in sections 30, 32 and 34 will always be under pressure, thus insuring against any leaks in the duct so that combustion air is never sucked into the heater and then directed out of the same.

The corrugations of the undulations on the inner surfaces of sections 30, 32 and 34 increase the heat absorption from the combustion area of the fireplace because of the increased surface area. This increased surface area is also on the inner surface of the heater and allows more contact with the air flowing through the heater to increase heat transfer to the air. The corrugations are also provided to prevent buckling of the metal of sections 30, 32 and 34 due to thermal stresses exerted thereon.

Figure 2:
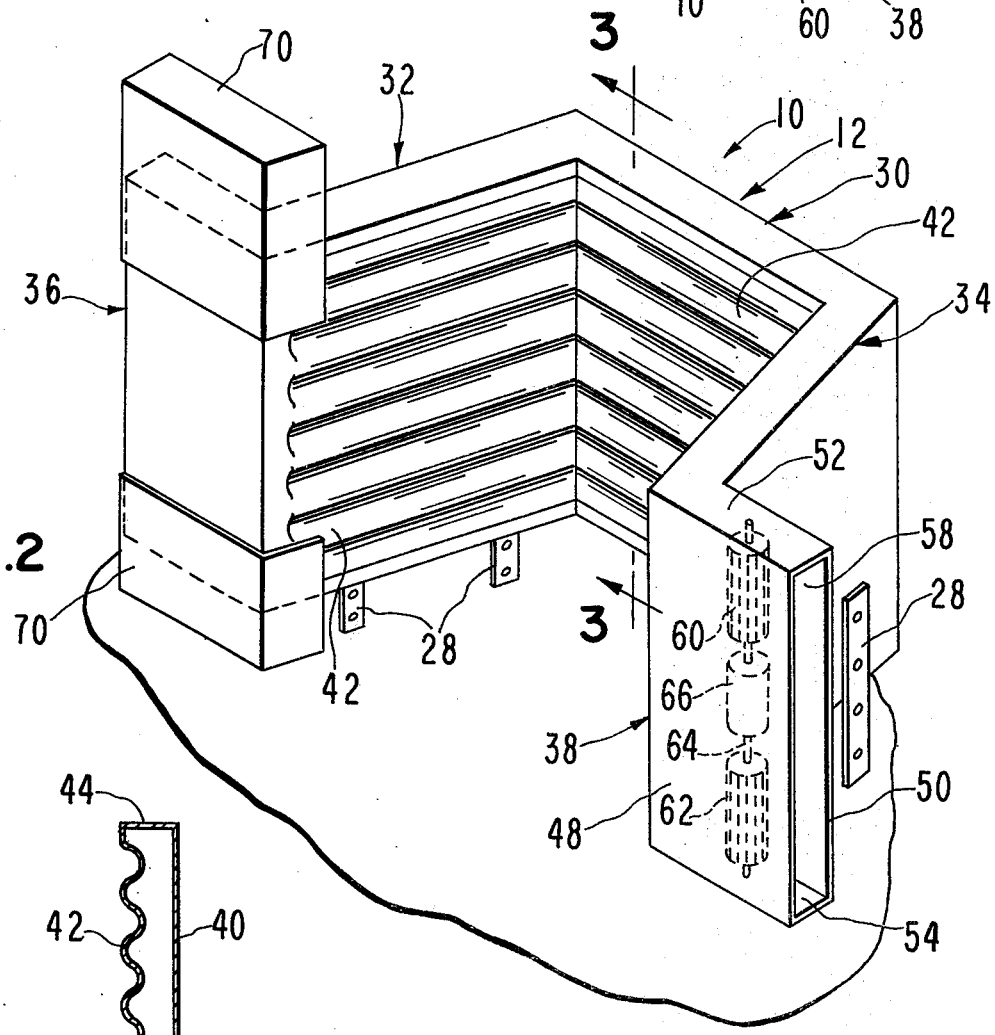
FIG. 2 is a perspective view of the fireplace.

Ordinary fans and centrifugal force cannot produce sufficient airflow if they were to be mounted within the size limits of heater 10. A special transverse flow type blower provides the high volume airflow necessary to obtain maximum heating efficiency from the heater itself. Also, adjustable decorative panels can be provided on the front faces of the extensions 36 and 38 to increase the esthetic appearance thereof and to render them such that they appear to extend the full height of the fireplace. Two such panels 70 are shown in FIG. 2 on extension 36 and are adjustable vertically, the decorative panels on extension 38 not being shown in FIG. 2 merely to simplify the drawing. A lower decorative panel can be provided near the lower end of each of extensions 36 and 38. Extensions 36 and 38 allow the heater to fit in fireplaces having front openings of different widths.

I claim:

1. A portable air heater for heating air with heat generated in a fireplace comprising: a hollow body having a first section and a pair of second sections rigidly and airtightly secured to respective ends of the first section, each section having a fluid passage therethrough, the second sections being in fluid communication with ends of the first section and extending laterally therefrom, the sections being constructed of a heat conductive material and defining outer surfaces for placement adjacent walls of the fireplace and inner surfaces for partially surrounding a fire in the fireplace, the height of the fluid passages of the sections being sufficient to extend throughout at least a major portion of the height of the fireplace, a hollow extension for each second section, respectively, the extensions being rigidly and airtightly secured to and extending laterally from respective second sections and projecting in opposite directions with respect to each other, each extension having a fluid passage and outer end provided with an opening, the height of the fluid passage of each extension and its opening being substantially equal to the height of the fluid passage of the adjacent section, the extensions, second sections and the first section defining an unobstructed, horizontal fluid passage extending from the outer end of one extension to the outer end of the other extension, elongated fan means disposed in one extension adjacent to and extending longitudinally of the opening thereof for inducing a flow of air through said one extension and the interior of the body to the opening in the other extension so that air in said flow is heated and the heated air is directed into the space adjacent to the fireplace.

2. A portable hot air heater for heating air with heat generated in a fireplace comprising: a hollow body having a first section and a pair of second sections rigidly and airtightly secured to respective ends of the first section, the second sections being in fluid communication with ends of the first section and extending laterally therefrom, the sections being constructed of a heat conductive material and defining outer surfaces for placement adjacent walls of the fireplace and inner surfaces for partially surrounding a fire in the fireplace, the inner surfaces being at least in part corrugated to increase the surface area thereof, a hollow extension for each second section, the extension being rigidly and airtightly secured to and extending laterally from respective second sections and projecting in opposite direction with respect to each other, the extension extending over the full height of the second sections, the outer end of each extension being open over its full height, the extensions, second sections and the first section defining an unobstructed, horizontal fluid passage extending from the open end of one extension to the open end of the other extension, the height to the fluid passages and the open ends of the extensions being sufficient to extend throughout at least a major portion to the height of the fireplace, elongated fan means disposed in one extension adjacent the end of such extension for inducing a substantially even airflow in the form of a curtain of air distributed over substantially the full height of the extensions and the interior of the body from the opening adjacent the fan through the extension, the sections, and to the opening in the other extension for discharge of air heated during the circulation through the interior of the body at a point remote from the air intake opening to thereby heat the air in a room surrounding the fireplace, and further including decorative means vertically adjustably secured to the extensions adjacent the respective ends of the second sections for defining a visible outer fireplace edge which has a vertically adjustable dimension for adapting the heater for use with fireplaces of differing heights.

* * * * *